US009167912B2

(12) United States Patent
Riddick

(10) Patent No.: US 9,167,912 B2
(45) Date of Patent: Oct. 27, 2015

(54) NURSING PILLOW

(71) Applicant: MAIN SQUEEZE PILLOW, LLC, Kerrville, TX (US)

(72) Inventor: Brian Riddick, Austin, TX (US)

( * ) Notice: Subject to any disclaimer, the term of this patent is extended or adjusted under 35 U.S.C. 154(b) by 0 days.

(21) Appl. No.: 14/596,465

(22) Filed: Jan. 14, 2015

(65) Prior Publication Data

US 2015/0196136 A1 Jul. 16, 2015

Related U.S. Application Data

(60) Provisional application No. 61/927,724, filed on Jan. 15, 2014.

(51) Int. Cl.
*A47D 13/00* (2006.01)
*A47D 13/08* (2006.01)

(52) U.S. Cl.
CPC ..... *A47D 13/083* (2013.01)

(58) Field of Classification Search
CPC ..... A47D 13/00
USPC ..... 5/655, 640, 632–633, 646
See application file for complete search history.

(56) References Cited

U.S. PATENT DOCUMENTS 6,061,854 A * 5/2000 Crowley ..... 5/655
2005/0278854 A1* 12/2005 Taricani, Jr. ..... 5/655

* cited by examiner

*Primary Examiner* — Fredrick Conley
(74) *Attorney, Agent, or Firm* — Pierson IP, PLLC

(57) ABSTRACT

Embodiments of this disclosure may include a nursing pillow system with a plurality of pillows. A first of the plurality of pillows may be configured to be positioned on a mother's lap while nursing an infant, the second of the plurality of pillows may be configured to be placed between the mother's legs while nursing the infant, and the first pillow may be configured to be positioned adjacent to the second pillow.

15 Claims, 6 Drawing Sheets

NURSING PILLOW

CROSS-REFERENCE TO RELATED APPLICATIONS

This application claims a benefit of priority under 35 U.S.C. §119 to Provisional Application No. 61/927,724 filed on Jan. 15, 2014, which is fully incorporated herein by reference in its entirety.

BACKGROUND INFORMATION

1. Field of the Disclosure

Examples of the present disclosure are related to systems and methods for a nursing pillow. More particularly, embodiments relate to a nursing pillow system that does not slip or move while a mother is nursing an infant.

2. Background

A nursing pillow is a pillow that a mother may use to position her infant during breast feeding. The nursing pillow helps prevent problems with nursing, and makes nursing a more comfortable experience for both the mother and the infant.

Conventionally, nursing pillows are crescent shaped and are configured to be placed on a mother's lap while the mother is nursing an infant. However, conventional nursing pillows do not have any means to secure the crescent shaped pillow to the mother's waist during nursing. Accordingly, while using conventional nursing pillows, the nursing pillow may move, which requires the mother to constantly and continuously reposition the nursing pillow.

To alleviate this issue, conventional nursing pillows may include an adjustable strap. The adjustable strap is configured to be strapped over the mother's waist and secure the nursing pillow in place. However, the adjustable strap requires two hands to secure the nursing pillow to the mother's waist. Thus, the mother is required to put down the infant in order to secure the adjustable strap over the mother's waist.

Accordingly, needs exist for more effective and efficient methods and systems for nursing pillows that may be secured to a mother via force applied by the mother's legs, and that may also be secured by the mother using only one hand.

SUMMARY

Embodiments of this disclosure may include a nursing pillow system with a plurality of pillows. A first of the plurality of pillows may be configured to be positioned on a mother's lap while nursing an infant, the second of the plurality of pillows may be configured to be placed between the mother's legs while nursing the infant, wherein the first pillow may be configured to be positioned adjacent to the second pillow.

In embodiments, the first and second of the plurality of pillows may be configured to be coupled (removable or permanently) together such that force applied by the mother's legs against the second of the plurality of pillows may also secure the first of the plurality of pillows in place. In embodiments, the pillows may be covered, enclosed, encompassed, etc. by a corresponding pillow case.

When a mother has an infant in her lap, it may be the mother's natural tendency to squeeze her legs together to generate a clamping force. This clamping force may be applied to the second of the plurality of pillows. By securing the second pillow in place, the mother may position the first of the plurality of pillows as close as desired, required, or needed for a comfortable nursing position.

Additionally, by the mother generating the clamping force that is applied to the second of the plurality of pillows, the mother is able to lean back and forth while the first of the plurality of pillows is still secured in place.

In further embodiments, the first pillow or the second pillow may include an anti-skid surface. The anti-skid surface of the first pillow may be configured to interface with a surface of the second pillow, and the anti-skid surface of the second pillow may be configured to interface with a surface of the first pillow.

In embodiments, the anti-skid surface of the first pillow may be configured to be positioned adjacent to the anti-skid surface of the second pillow to provide a skid resistance surface that reduces or eliminates the possibility of the first pillow moving if horizontal force is applied to the first pillow.

In embodiments, the anti-skid surface may be coupling mechanisms, such as Velcro, buttons, hooks, etc.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
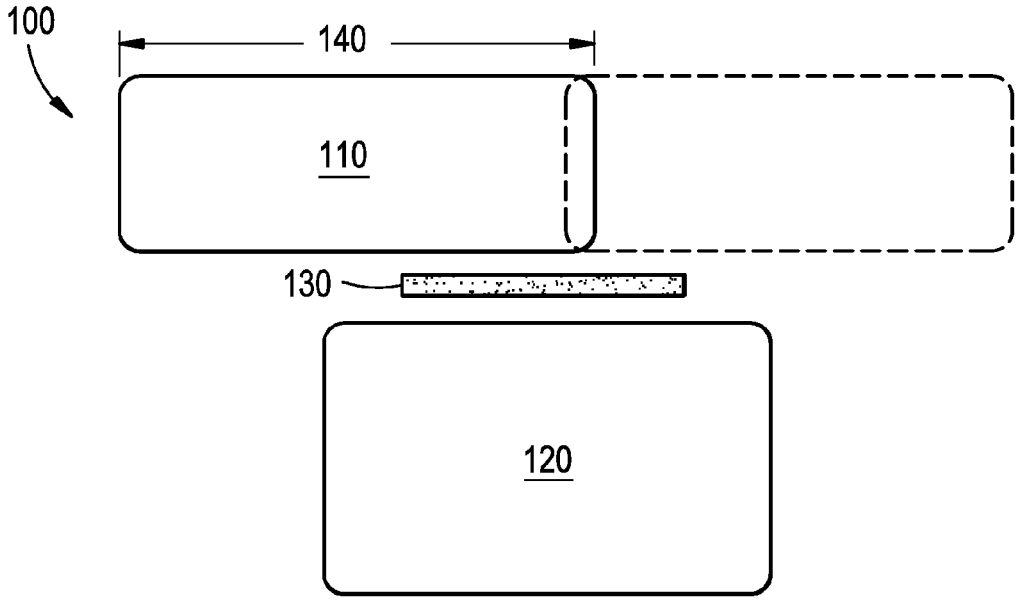
FIG. 1 depicts a side view of an embodiment of a nursing pillow system.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent to one having ordinary skill in the art, that the specific detail need not be employed to practice the present embodiments. In other instances, well-known materials or methods have not been described in detail in order to avoid obscuring the present embodiments.

FIG. 1 depicts a side view of an embodiment of a nursing pillow system 100. Nursing pillow system 100 may include a first pillow 110, a second pillow 120, and fastener 130.

First pillow 110 and second pillow 120 may be comprised of any type of fabric or a plurality of different types of fabric including plastic, cotton, wool, nylon, acrylic, etc., and may be manufactured in a plurality of styles, shapes, and/or sizes. In one embodiment, second pillow 120 may be shaped as a nursing style pillow. Further, an outer surface of first pillow 110 and/or second pillow 120 may be covered by a corresponding pillow case. First pillow 110 and second pillow 120 may be configured to be any type of cushion support for a mother and/or an infant. First pillow 110 may be configured to be positioned over and adjacent to second pillow 120, and first pillow and second pillow 120 may be coupled together via fastener 130.

In embodiments, first pillow 110 may be configured to hold or secure an infant positioned on an upper surface of first pillow 110. Second pillow 120 may be configured to be positioned between a mother's legs, and side surfaces of second pillow 120 may be configured to receive force from the mother's legs to secure first pillow 110 and second pillow 120 in place. In one embodiment, if first pillow 110 is coupled to second pillow 120, nursing pillow system 100 may correspond to an I-beam. For example, a first portion of the nursing pillow system 100 may be disposed on a top surface of a user's legs and a second portion of nursing pillow system 100 may be disposed on bottom surface of the user's legs.

Fastener 130 may include a first portion coupled to a surface of first pillow 110 and a second portion coupled to a surface of second pillow 120. In further embodiments, the first portion of fastener 130 may be coupled to a first pillow case covering first pillow 110 and/or a second portion of fastener 130 may be coupled to a second pillow case covering second pillow 120. Fastener 130 may be any type of fastener 130 that is configured to secure, hold, grip first pillow 110 to second pillow 120. For example, fastener 130 may include snaps, a hoop and lock mechanism such as Velcro, a zipper, button(s), buckle(s), clip(s), anti-skid surface(s), etc. that may be used to removably couple first pillow 110 and second pillow 120. In embodiments, fastener 130 may be permanently or removably coupled to the surface of first pillow 110 and/or the surface of second pillow 120. Therefore, in embodiments, fastener 130 may be removed from nursing pillow system 100 if desired. One skilled in the art will appreciate that a first portion of fastener 130 may be positioned on first pillow 110 and a second portion of fastener 130 may be positioned on second pillow, where the first portion may be a male interface of fastener 130 and the second portion may be a female interface of fastener 130, or vice versa.

If first pillow 110 is coupled to second pillow 120 via fastener 130, first pillow 110 may be positioned on top of and adjacent to second pillow 120. Responsive to coupling first pillow 110 to second pillow 120, first pillow 110 may be able to be positioned on second pillow 120 within a range of adjustment 140. Range of adjustment 140 may be a length from the center of an upper surface of second pillow 120 where first pillow 110 may be positioned. Range of adjustment 140 may vary based on the type of fastener 130 used to secure first pillow 110 and second pillow 120.

In embodiments, if a mother has placed an infant on the top surface of first pillow 110, the mother's natural tendency may be to squeeze her legs together to generate a clamping force on second pillow 120. When the mother is generating clamping force on second pillow 120, the mother may position first pillow 110 within the range of adjustment 140. Therefore, a mother may comfortably and securely position an infant on first pillow 110 using the mother's legs and a single arm without first pillow 110 slipping off the mother's lap.

Figure 2:
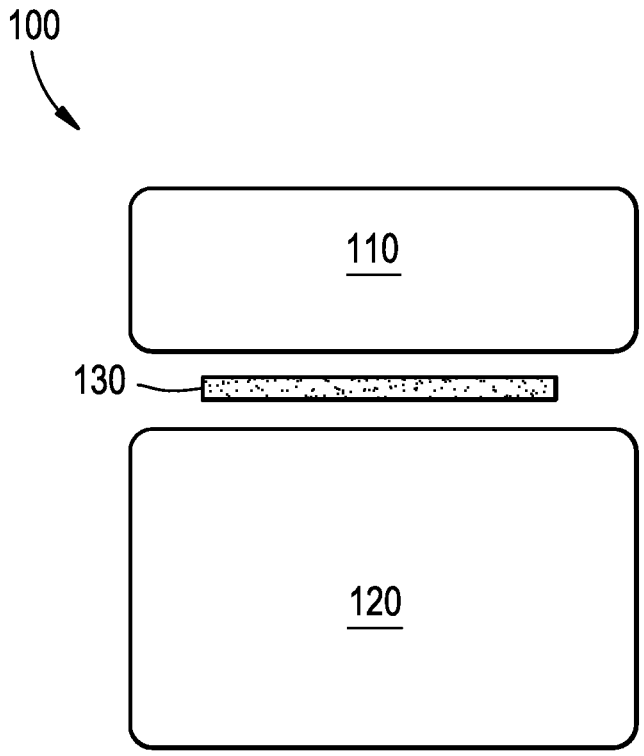
FIG. 2 depicts a front view of an embodiment of a nursing pillow system.

FIG. 2 depicts a front view of an embodiment of nursing pillow system 100. As depicted in FIG. 2, if first pillow 110 is coupled to second pillow 120 via fasteners 130 then a bottom surface of first pillow 110 may be positioned adjacent to a top surface of second pillow 120.

Figure 3:
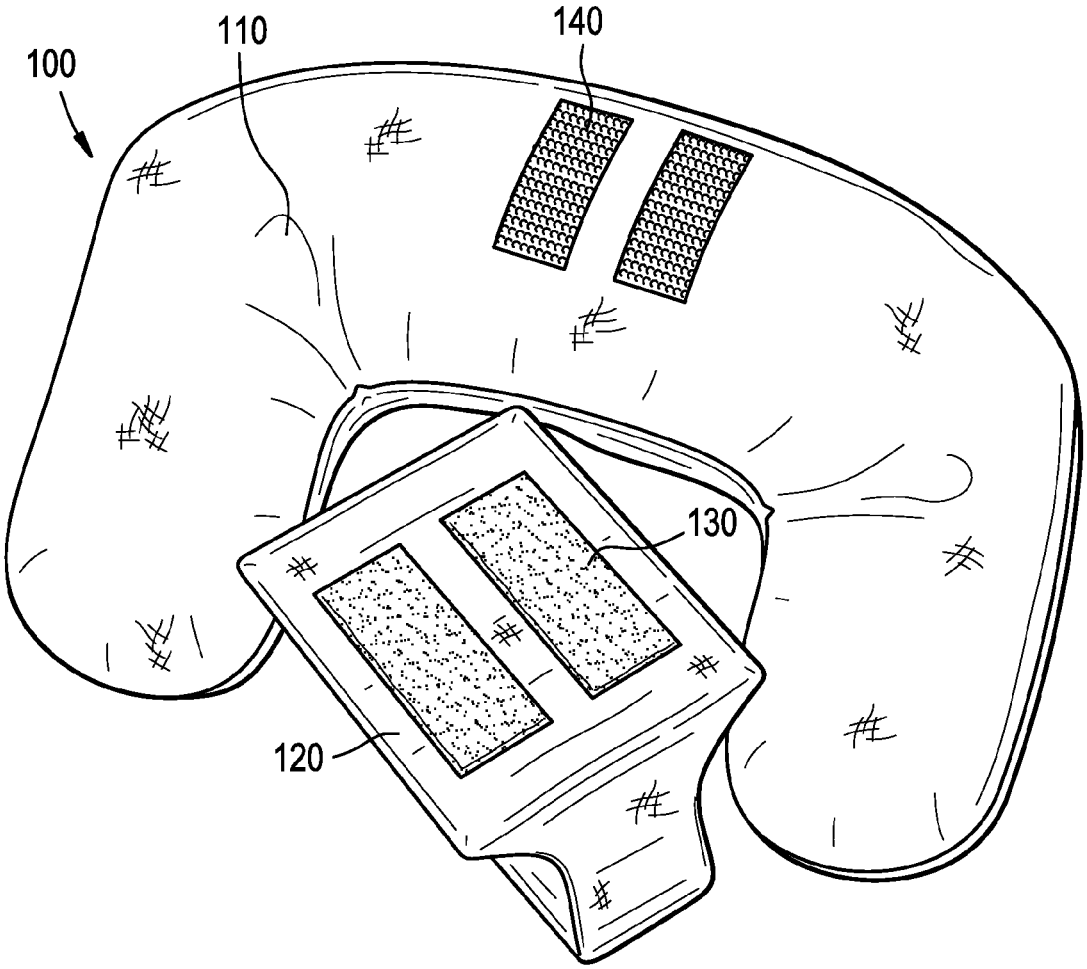
FIG. 3 depicts a top view of a second embodiment of a nursing pillow system.

FIG. 3 depicts a top view of a second embodiment of nursing pillow system 100. Elements depicted in FIG. 3 may be substantially the same as elements depicted in FIGS. 1-2 therefore for the sake of brevity an additional description of these elements is omitted.

As depicted in FIG. 3, first pillow 110 may have a crescent shape. In other words, first pillow 110 may have a curved or somewhat round shape, with a concave indentation. In embodiments, the crescent shape of first pillow 110 may be configured to allow an infant to be positioned within the concave indentation of first pillow 110.

In further embodiments, the concave indentation of first pillow 110 may be positioned such that the concave indentation is facing away from a mother's face if second pillow 120 is secured between a mother's legs. Accordingly, the concave indentions within second pillow 120 may be perpendicular to the concave indention within first pillow 110.

Additionally, as depicted in FIG. 3, second pillow 120 may include a plurality of fasteners 130. The plurality of fasteners 130 may be configured to interface with fasteners 140 positioned on any portion of the top surface of crescent shaped first pillow 110. In the embodiment depicted in FIG. 3, the fasteners 130 and 140 may be matting hook and loop coupling mechanisms, such as Velcro.

In one embodiment, a first fastener 140 may be positioned on a bottom surface of crescent shaped pillow 110 and a second fastener 130 may be positioned on an upper surface of crescent shaped pillow, where the first side is a right side and the second side is a left side. The plurality of fasteners 130 on the top surface of second pillow 120 interfacing with fasteners 140 positioned on the bottom surface of first pillow 110 may be configured to limit, reduce, or eliminate sliding of first pillow 110.

Figure 4:
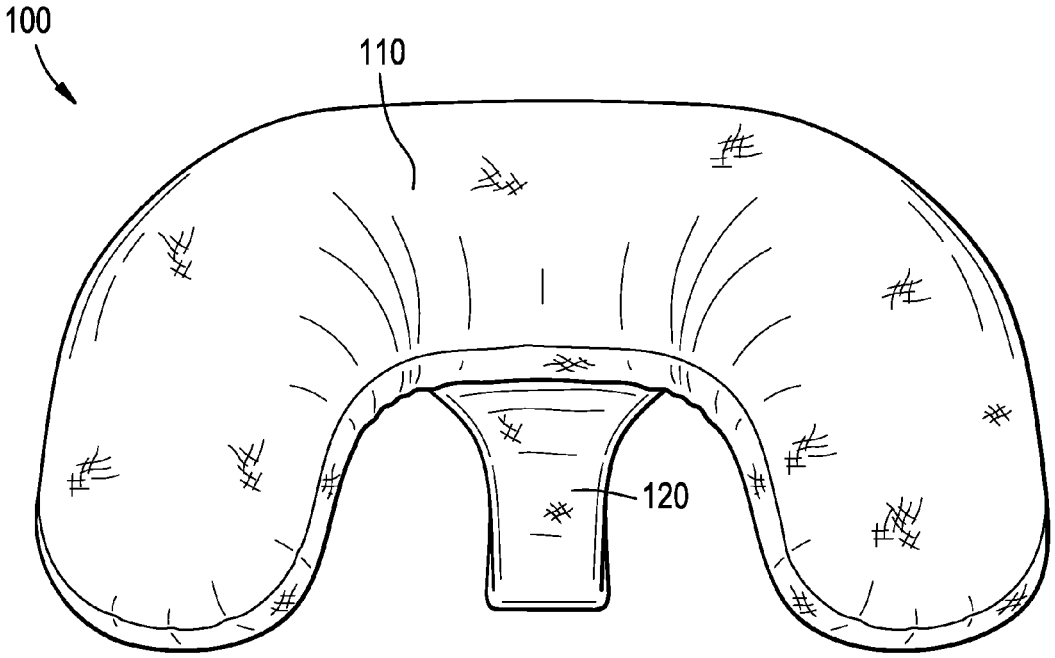
FIG. 4 depicts a front view of the second embodiment of a nursing pillow system.

FIG. 4 depicts a front view of the second embodiment of nursing pillow system 100. Elements depicted in FIG. 4 may be substantially the same as elements depicted in FIGS. 1-3 therefore for the sake of brevity an additional description of these elements is omitted.

As depicted in FIG. 4, second pillow 120 may include sidewalls with concave indentation. The sidewalls with concave indentations of second pillow 120 may be configured to interface with a mother's legs to secure nursing pillow system 100 in place. Furthermore, the bottom surface of first pillow 110 may be configured to be positioned adjacent to an upper surface of the mother's legs, while first pillow 110 and second pillow 120 are coupled together. In embodiments, the sidewalls with concave indentions may be positioned perpendicularly to the concave indentation of first pillow 110

Figure 5:
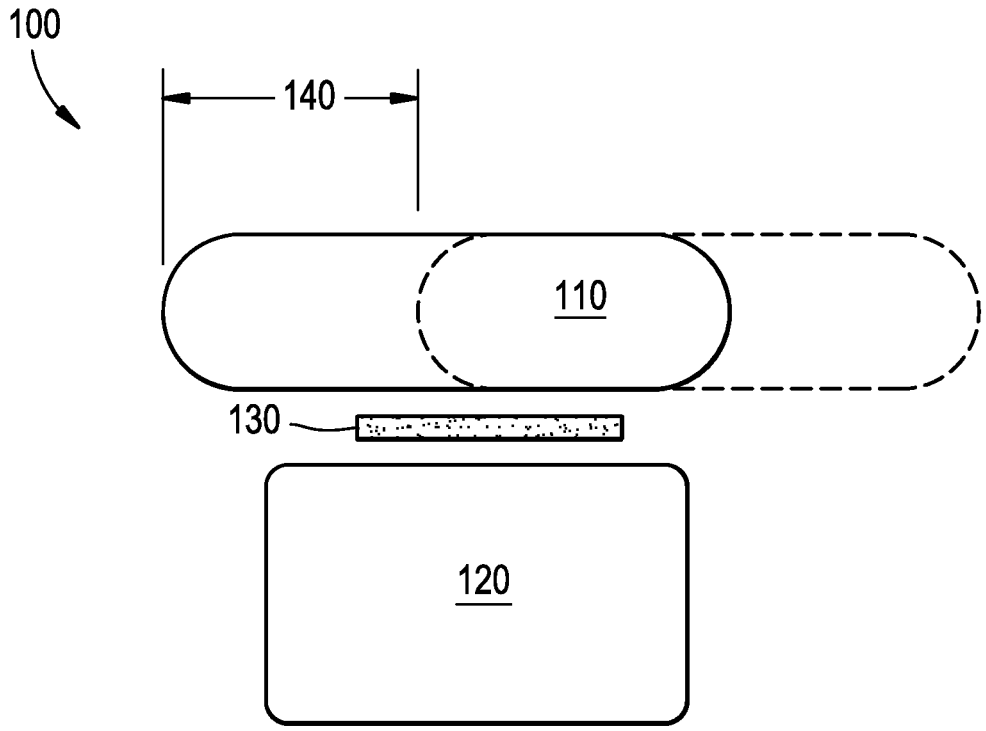
FIG. 5 depicts a side view of the second embodiment of nursing pillow system.

FIG. 5 depicts a side view of the second embodiment of nursing pillow system 100. Elements depicted in FIG. 5 may be substantially the same as elements depicted in FIGS. 1-4 therefore for the sake of brevity an additional description of these elements is omitted.

If first pillow 110 is coupled to second pillow 120 via fastener 130, first pillow 110 may be positioned adjacent to second pillow 120. Responsive to coupling first pillow 110 to second pillow 120, first pillow 110 may be able to be positioned on second pillow 120 within a range of adjustment 140. Range of adjustment 140 may be a length from the center of an upper surface of second pillow 120 where first pillow 110 may be positioned. Range of adjustment 140 may vary based on the type of fastener 130 used to secure first pillow 110 and second pillow 120.

Figure 6:
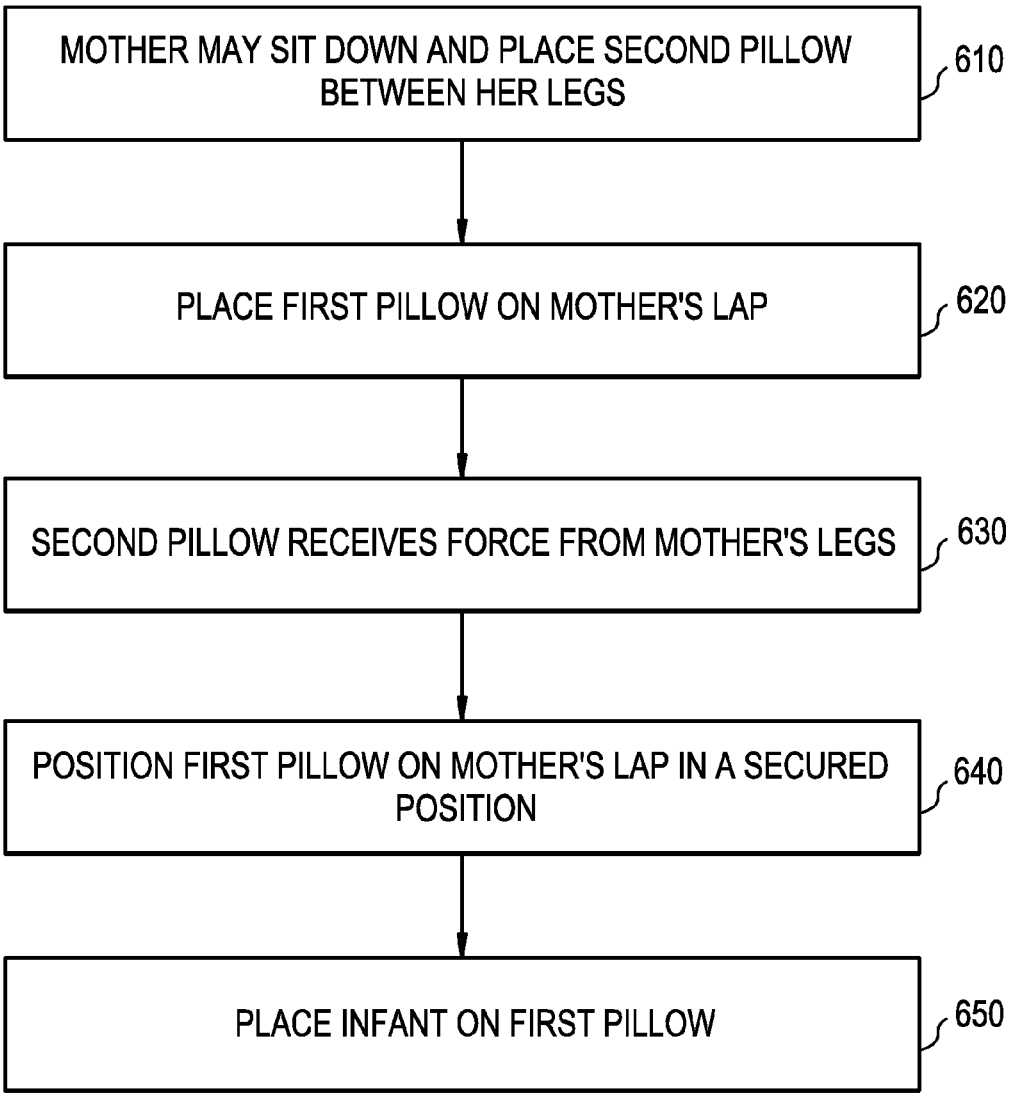
FIG. 6 depicts an embodiment of a method for a nursing pillow system

FIG. 6 illustrates a method 600 for a nursing pillow system. The operations of method 600 presented below are intended to be illustrative. In some embodiments, method 600 may be accomplished with one or more additional operations not described, and/or without one or more of the operations discussed. Additionally, the order in which the operations of method 600 are illustrated in FIG. 6 and described below is not intended to be limiting.

At operation 610, a mother may sit down and place a second pillow of a nursing pillow system between their legs. Operation 610 may include a second pillow that is the same as or similar to second pillow 120, in accordance with one or more implementations.

At operation 620, a first pillow may be secured to the second pillow via fasteners. In one embodiment, the first pillow may be secured to the second pillow via Velcro, snaps, buckles, etc. Operation 620 may include a first pillow, second pillow, and fasteners that are the same as or similar to first pillow 110, second pillow 120, and fasteners 130.

At operation 630, sidewalls of the second pillow may be configured to receive force generated by the mother's legs to secure the second pillow in place between the mother's legs. Operation 630 may include a second pillow that is the same as or similar to second pillow 120, in accordance with one or more implementations.

At operation 640, the first pillow may be positioned and secured on the mother's lap. The first pillow may be positioned within a range of adjustment between the first pillow and/or the second pillow, wherein the range of adjustment may vary based on the type of fasteners used. Operation 640 may include a first pillow, second pillow, and fasteners that are the same as or similar to first pillow 110, second pillow 120, and fasteners 130.

At operation 650, an infant may be placed on the first pillow and the mother may begin nursing the infant. While the infant is placed on the first pillow, the first pillow may move within the range of adjustment for the nursing pillow system, such that the mother may safely, comfortably, and securely reposition the first pillow on the mother's lap while the first pillow is coupled to the second pillow. Operation 650 may include a first pillow, second pillow, and fasteners that are the same as or similar to first pillow 110, second pillow 120, and fasteners 130.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The flowcharts and block diagrams in the flow diagrams illustrate the architecture, functionality, and operation of possible implementations of systems, methods, and computer program products according to various embodiments of the present invention. In this regard, each block in the flowcharts or block diagrams may represent a module, segment, or portion of code, which comprises one or more executable instructions for implementing the specified logical function(s).

What is claimed is:

1. A nursing pillow system comprising:

a first nursing pillow with a first concave indention and first fasteners; and a second nursing pillow with a second concave indention, a third concave indention, and second fasteners, wherein the first concave indention is positioned perpendicular to the second concave indention and the third concave indention, and the first fasteners are configured to couple with the second fasteners, the second nursing pillow including a flat upper surface and a flat lower surface, a flat front sidewall, and a flat rear sidewall, the flat upper surface being wider than the flat lower surface with the second fasteners being positioned on the flat upper surface, the second concave indention being positioned on a first sidewall of the second nursing pillow, and the third concave indention being positioned on a second sidewall of the second nursing pillow, wherein a first height associated with the first nursing pillow is less than a second height associated with the second nursing pillow.

2. The nursing pillow system of claim 1, wherein responsive to coupling the first nursing pillow and the second nursing pillow and applying pressure to the second concave surface and the third concave surface, the first nursing pillow will be secured in place.

3. The nursing pillow system of claim 1, wherein the second nursing pillow is configured to be positioned between legs of a user, wherein the second concave indention is configured to interface with a first leg of the user and the third concave indention is configured to interface with a second leg of the user.

4. The nursing pillow system of claim 3, wherein the planar bottom surface of the first nursing pillow is configured to be positioned over the legs of the user.

5. The nursing pillow system of claim 1, wherein the first fasteners and the second fasteners are Velcro fasteners.

6. The nursing pillow system of claim 1, wherein the first nursing pillow and the second nursing pillow are configured to be removably coupled to each other.

7. The nursing pillow system of claim 1, wherein an infant is configured to be positioned over the first nursing pillow.

8. A method of using a nursing pillow system, the method comprising:

positioning a second nursing pillow with a second concave indention and a second concave indention in-between the legs of a user, wherein a second concave indention is positioned adjacent to a first leg of the user and a third concave indention is positioned adjacent to a second leg of the user, the second nursing pillow including a flat upper surface and a flat lower surface, a flat front sidewall, and a flat rear sidewall, the flat upper surface being wider than the flat lower surface with the second fasteners being positioned on the flat upper surface, the second concave indention being positioned on a first sidewall of the second nursing pillow, and the third concave indention being positioned on a second sidewall of the second nursing pillow;

coupling a first nursing pillow with the second nursing pillow, wherein the first nursing pillow includes a first concave indention, the first concave indention being perpendicular to the second and third concave indention, wherein a first height associated with the first nursing pillow is less than a second height associated with the second nursing pillow.

9. The nursing method of claim 8, further comprising:

positioning an infant over the first nursing pillow.

10. The method of claim 8, further comprising:

applying force to the second concave indention and the third concave indention to secure the first nursing pillow in place.

11. The method of claim 10, wherein the first nursing pillow includes first fasteners positioned on a bottom planar surface of first nursing pillow.

12. The method of claim 11, wherein the second nursing pillow includes second fasteners positioned on the upper surface of the second nursing pillow.

13. The method of claim 12, further comprising:

coupling the first fasteners with the second fasteners.

14. The method of claim 13, wherein the first fasteners and the second fasteners are Velcro fasteners.

15. The method of claim 8, wherein the first nursing pillow and the second nursing pillow are configured to be removably coupled to each other.

* * * * *